United States Patent [19]

Welsch et al.

[11] 4,444,125

[45] Apr. 24, 1984

[54] KNOCK DOWN WORK TABLE

[75] Inventors: John H. Welsch, Moscow; Rodney Brancher, Wilkes-Barre, both of Pa.

[73] Assignee: Metropolitan Wire Corporation, Wilkes-Barre, Pa.

[21] Appl. No.: 333,995

[22] Filed: Dec. 23, 1981

[51] Int. Cl.[3] ..... A47B 3/06; A47B 3/12

[52] U.S. Cl. ..... 108/155; 108/153; 108/144; 248/188; 211/135

[58] Field of Search ..... 108/64, 111, 153, 154, 108/155, 156, 158, 159, 161; 248/412, 188, 188.8; 211/135

[56] References Cited

U.S. PATENT DOCUMENTS

| | | | |
|---|---|---|---|
| 1,713,225 | 9/1924 | Haase | 108/64 |
| 3,339,504 | 9/1967 | Schreyer | 248/188 |
| 3,424,111 | 1/1969 | Maslow | 108/144 |
| 3,874,511 | 4/1975 | Maslow | 108/156 |
| 4,011,821 | 3/1977 | Neal | 108/156 |
| 4,269,318 | 5/1981 | Levitt | 211/135 |

*Primary Examiner*—William E. Lyddane
*Assistant Examiner*—Thomas A. Rendos
*Attorney, Agent, or Firm*—Goodman & Teitelbaum

[57] ABSTRACT

A work table having a table top with a uniform planar upper surface, truncated corners and a frame on the underside thereof. Depending from the frame are corner collar members with a respective tapered bore therein. The table top is supported by corner support posts each of which include recesses at least adjacent to the respective upper ends thereof. A pair of matingly engaging sleeve sections clamp around each support post. The sleeve sections, when joined, provide a corresponding tapered exterior surface. A protusion, internally of the sleeve sections, locks into an associated recess on the support posts. The corner collar members receive the respective pairs of sleeve sections and urge them into secure clamping engagement of the support posts. The work table can include a frame support therebelow or an adjustable shelving therebelow.

18 Claims, 9 Drawing Figures

KNOCK DOWN WORK TABLE

BACKGROUND OF THE INVENTION

This invention relates to a work table, and more particularly to a work table which can be easily assembled and provide with positive securement in its assembled condition.

A novel approach to shelving has been described in the prior art, wherein corner support posts are used with spaced apart recesses which support the shelving. A pair of mating half sections form a sleeve, whereby these sleeves engage the support posts. Each of the sleeves includes a projection which locks into a recess on the support posts. The exterior surface of each of the sleeves forms a downwardly flaring tapered surface. Corner connectors are attached to the shelving by means of clamps, bars, bolts, etc. Each of the corner connectors have a tapered bore extending entirely therethrough which corresponds in shape to the exterior taper of the pair of sleeve sections. The tapered bore receives therein the sleeve sections, and the corner connectors force the sleeve sections together to further tightly clamp onto the support posts.

The aforementioned shelves can be easily adjusted so that the projection on the inside surface of the sleeve can be placed in any desired recess along the height of the support posts. In this way, the shelves can be placed in any desired vertical position on the support posts.

The aforementioned type of shelving has been described in U.S. Pat. Nos. 3,424,111; 3,523,508; 3,604,369; 3,757,705 and 3,874,511, the contents of which are all herein incorporated by reference. A further improved shelving is also described in copending U.S. patent application No. 252,812, filed Apr. 10, 1981, now abandoned, assigned to the assignee of the present invention, the entire disclosure of which is herein incorporated by reference.

Although this type of arrangement has been shown to be extremely useful for shelving, in many situations a work table is desired which includes a table top which extends completely across the upper surface of the supports. Such work tables require adequate rigidity and strength since the work top surface is often utilized for heavy equipment or work. Furthermore, it is necessary that such work table be secure and available in various sizes, and often undershelves are also desirable.

At present, such work tables are available either as being custom built or are provided as a standard type with a wide range of sizes. When such work tables are used in the food service business, an additional requirement concerns cleanliness and avoidance of contamination. Any cracks, crevices, or breaks in the work surface will provide a place for food particles to accumulate with the possibility of contamination, infection and collection of insects. As a result, work tables for use in food service establishments must have very high standards and only specialized types of work tables are utilized. Normally, the tops are of stainless steel with a galvanized steel reinforcing frame in order to maintain rigidity and cleanliness. Some prior art work tables for use in the food service industry are fixed, and are held together by welds or threaded fasteners. These tables are difficult to ship and store since they come preassembled and accordingly take a large volume of space. The knock down tables which are available require the use of tools for assembly and, once assembled, are not as rigid as might be desired. Also, any undershelf which is provided is difficult to readjust. For example, the adjustment or the addition of shelves would require drilling of new holes, and removal of the old shelves requires sealing of the unused holes in order to preclude the chance of contamination.

An additional problem with the prior art available work tables concerns the table top and its corners. In some situations, the table top upper surface is not continuous or uninterrupted, and accordingly, includes cracks and crevices, all of which can provide difficulties when they must be cleaned. Furthermore, they provide areas of possible accumulation of food particles with the possibility of contamination. Additionally, the corners which are provided on the table top are often objectionable since they include vertical seams, spherical shapes, or other hard corners which are prone to cause accidents and are difficult to work with.

It would appear that the previously described type of coupling arrangement used in connection with shelving might also be utilized in conjunction with work tables. However, the usual corner connectors would cause seams, cracks an crevices in the upper surface which would not be acceptable. Furthermore, in the case of shelving, the corner support posts normally come directly at the corners of the shelving and again this would be objectionable since a work table must overhang the end of the corner posts. Also, while shelving can be adjusted along the height of the support post, in the case of work tables, the top surface must come above the upper ends of the support posts, and accordingly the prior teachings concerning the coupling arrangements for shelving could not necessarily find direct utilization in connection with work tables.

SUMMARY OF THE INVENTION

Accordingly, it is an object of the present invention to provide a knock down work table which avoids the aforementioned problems of prior art devices.

Another object of the present invention is to provide a work table whick utilizes the aforedescribed shelving concepts and provides the necessary modifications needed in order to form a knock down work table.

Still another object of the present invention is to provide a knock down work table which includes a continuous, uniform, planar upper surface which is uninterrupted by cracks, crevices, welds, etc.

Yet another object of the present invention is to provide a work table having a continuous upper table top surface, and which includes easily adjustable lower shelving beneath the table top.

A further object of the present invention is to provide a work table having a support surface connected to the underside of the table top, and which can be supported on support posts.

Yet another object of the present invention is to provide a work table top coupled to corner supports such that increased loading of the work table enhances engagement of the corner posts.

Briefly, in accordance with the present invention, there is provided a work table having a table top and corner support posts for supporting the table top. Recesses are provided on each support post adjacent to the respective upper ends thereof. A pair of matingly engaging sleeve sections are provided for clamping around each support post. The sleeve sections join together to provide a tapered exterior surface. A protusion is provided internally of the sleeve sections for locking into a recess on the support posts. A corner collar member having a tapered bore therein is secured to the underside of the table top for receiving a respective pair of the sleeve sections and urging the sleeve sections into secure clamping engagement on the support posts.

In an embodiment of the present invention, the table top has a continuous, uniform, planar, upper surface which is uninterrupted by cracks or crevices.

The edges of the table top can be truncated, and a continuous downwardly depending skirt can be provided peripherally about the table top.

In an embodiment of the present invention, beneath the table top, there can be provided easily adjustable shelves. Alternately, a three sided frame can be provided for additional support. Both the three sided frame and the shelving can be adjustably positioned at a desired height on the support posts.

BRIEF DESCRIPTION OF THE DRAWINGS

With the above and additional objects, and advantages in view, as will hereinafter appear, this invention comprises the devices, combinations and arrangements of parts hereinafter described by way of example, and illustrated in the accompanying drawings of a preferred embodiment in which.

In the various figures of the drawing, like reference characters designate like parts.

DETAILED DESCRIPTION OF THE PREFERRED EMBODIMENTS

Figure 1:
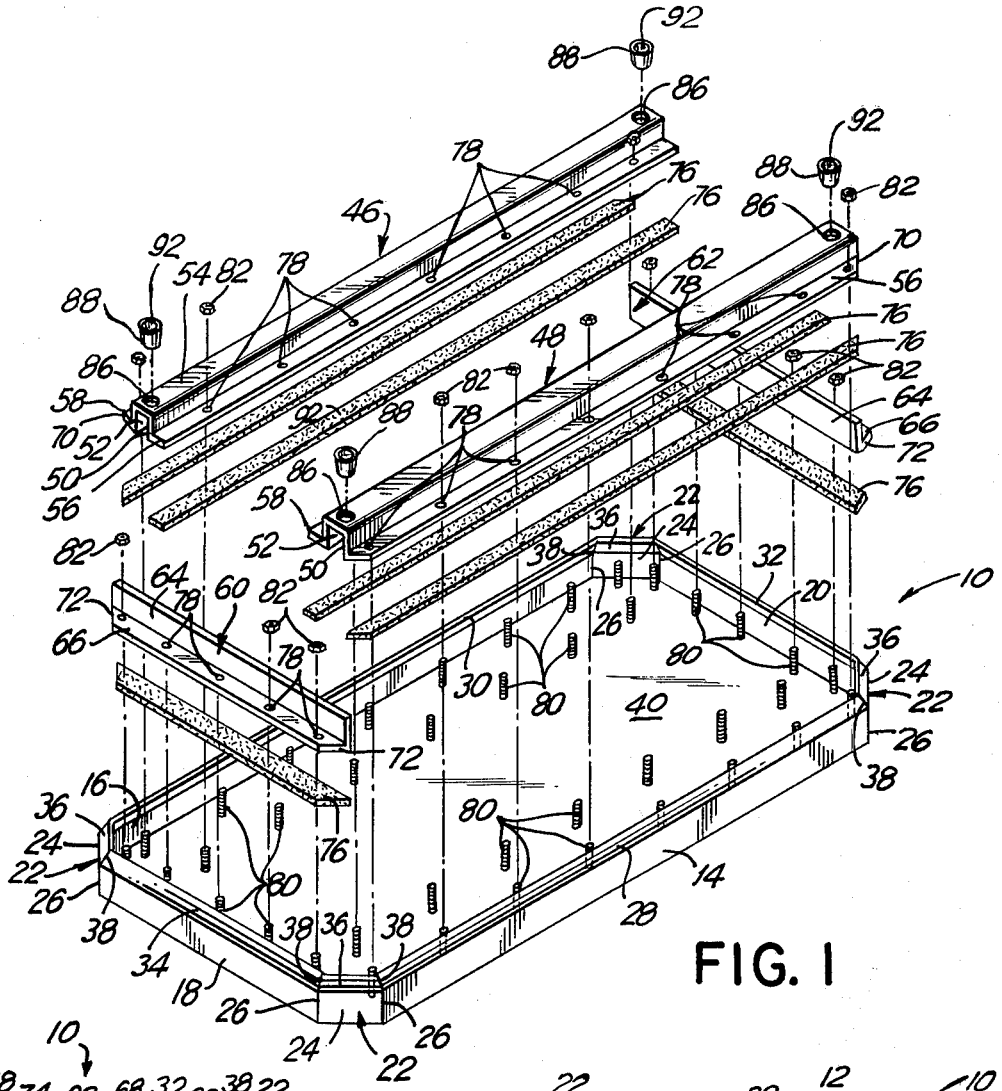
FIG. 1 is an exploded, perspective view showing the underside of the table top, in accordance with the present invention.
Figure 2:
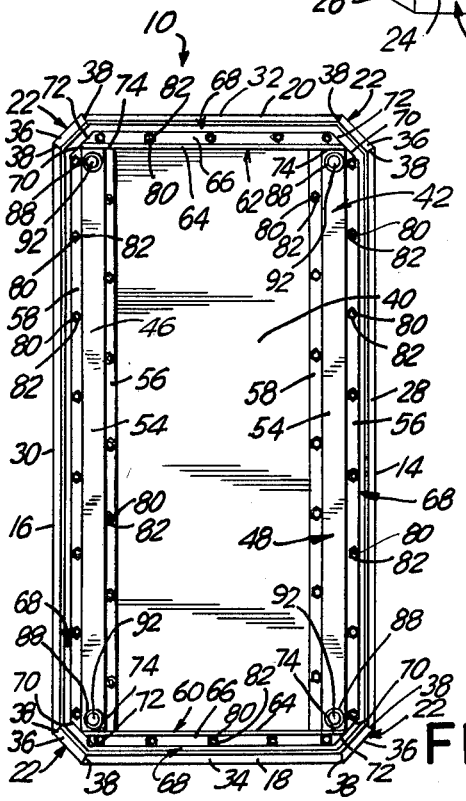
FIG. 2 is a bottom plan view of the table top in an assembled condition.
Figure 3:
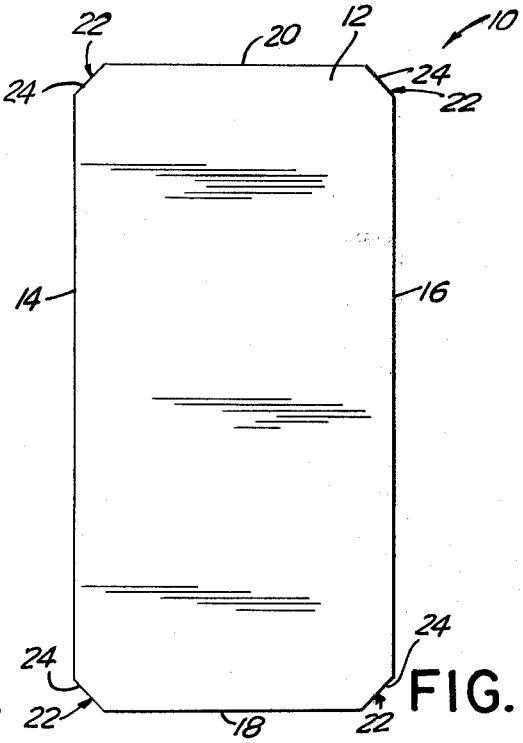
FIG. 3 is a top plan view of the table top showing it as being uninterrupted by cracks or crevices.

Referring now to FIGS. 1—3, there is generally shown a table top 10 of a work table which includes an upper surface 12 which is uniform, continuous and without the interruption of any cracks or crevices. Such table top 10 is of special importance in the food service industry where the presence of cracks and crevices in such table top would provide for the possibility of collection of food particles and dirt accumulation for possible contamination. Such planar table top is typically made of suitable metal.

A downwardly depending skirt portion is formed peripherally about the table top, and includes the side skirt portions 14, 16 and the end skirt portions 18, 20. The corners are truncated, as shown at 22 and includes the interconnecting skirt portion 24 which interconnects each of the respective side and end skirt portions. Welds 26 are provided along the seams so as to provide a continuous skirt portion about the entire periphery of the shelf without any open spaces, cracks or crevices.

Inwardly directed from the distal end of the skirt portions is provided a lip including the side lip sections 28, 30 and the end lip sections 32, 34. The truncated corners include the lip sections 36 which are interconnected between side and end lip sections and are welded to them by means of the weld seams 38. Again, a continuous peripheral lip portion is provided without any cracks or crevices therein.

Connected to the underside surface 40 of the table top 10 is provided a substantially rectangular frame, shown generally at 42. The frame 42 is formed by means of two side channels 46, 48 each of substantially U-shaped cross sectional configuration so as to include the legs 50, 52 interconnected by the bight portion 54. Laterally extending from leg 50 is the connecting arm 56, with a similar connecting arm 58 extending from the leg 52.

At the two ends of the frame 42 are provided substantially L-shaped angle members 60, 62. Each of the angle members include an upwardly extending leg 64 whose height is substantially equal to the depth of the channels 46, 48, and a laterally extending connecting leg 66.

The L-shaped end angle members 60, 62 close off the open ends of the channels 46,48 at both their opposing ends, and also space the channels 46, 48 apart so as to complete the rectangular shape of the frame 42. The size of the rectangular frame 42 is such as to be slightly less than the periphery of the table so that when attached to the underside surface 40 of the table top, a space 68 is provided peripherally between the lateral edge of the frame and the lip portion of the table top.

The corners of the frame 42 are truncated to conform to the truncated end sections 22 on the table top. Specifically, it will be noted that opposite ends of the laterally extending connecting arm 56 on the U-shaped side channel 46 and of the connecting arms 58 on the U-shaped side channel 48 are angularly cut, as shown at 70. Correspondingly, both ends of each connecting leg 66 of the end angle members 60, 62 are angularly cut as shown at 72, so as to form the truncated frame corners, as can best be seen in FIG. 2. The truncated frame corners 70, 72 are substantially parallel to the truncated corners 22 of the table top 10.

The end angle members 60, 62 are welded onto the ends of the channels 46, 48 by means of the welds 74. In this manner, a completely closed frame 42 is provided which avoids the possibility of collection of any food or dirt particles which can form contamination.

In order to seal the frame 42 onto the underside surface 40 of the table top and avoid metal to metal contact, strips of foam tape 76 are utilized. Preferably, double sided tape is used. The tape 76 is initially placed on the underside of the connecting arms 56, 58 of the U-shaped side channels 46, 48. Likewise, the tape 76 is placed under the connecting legs 66 of both end angle members 60, 62.

A plurality of spaced apart apertures 78 are formed in both the laterally extending connecting arms 56, 58 of the two side channels 46, 48, as well as in the connecting legs 66 of both end angle members 60, 62. These apertures 78 are spaced apart so as to receive the extending fastening members 80 projecting from the undersurface 40 of the table top. By way of example, these fastening members 80 can be threaded studs whose heads are welded to the underside of the table top. The welding of such studs can be done in a known manner using a tool which is available in the art.

With the tape fastened onto the connecting arms 56, 58, and the connecting legs 66, the substantially rectangular frame 42 can be pressed downwardly so that the fastening members 80 pierce through the connecting tape 76 and pass through the apertures 78. Appropriate nuts 82 can then be fastened onto the protruding ends of the fastening members 80. Typically, nuts 82 will have a laterally extending flange which will sit within the surface of the connecting arms 56, 58 and the connecting legs 66 of the frame 42, so as to prevent any food particles or dirt from collecting on the frame 42.

Figure 7:
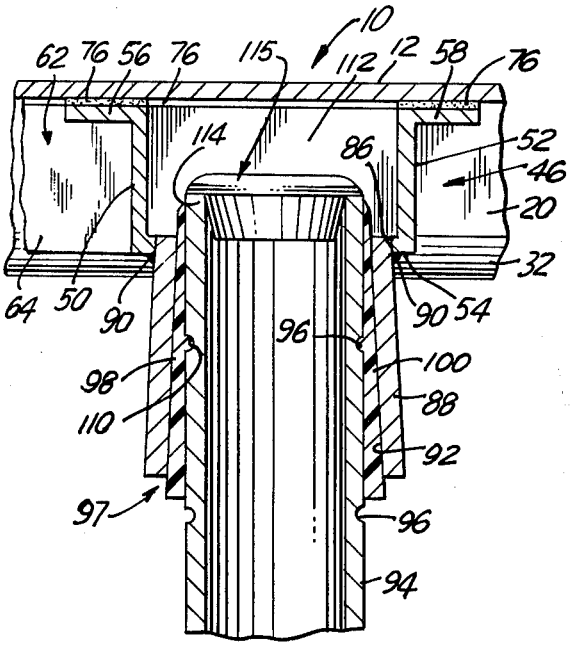
FIG. 7 is a cross sectional view taken along line 7—7 of FIG. 6, showing the interconnection of the table top onto the support posts.

Adjacent to the distal ends of each bight portion 54 of the U-shaped side channels 46, 48, there are formed apertures 86 which receive frostroconical collars 88 which are secured to the bight portions 54 by means of a weld 90, as can best be seen in FIG. 7. Interiorly of the collars 88 is formed a tapered bore 92. The collars 88 can be formed of a single sheet of metal which is bent around into a frustroconical shape. Alternately, it can be formed of two mating sections which are joined. Other arrangements for forming such frustroconical collars 88 can be achieved in accordace with well known fabrication methods.

Figure 5:
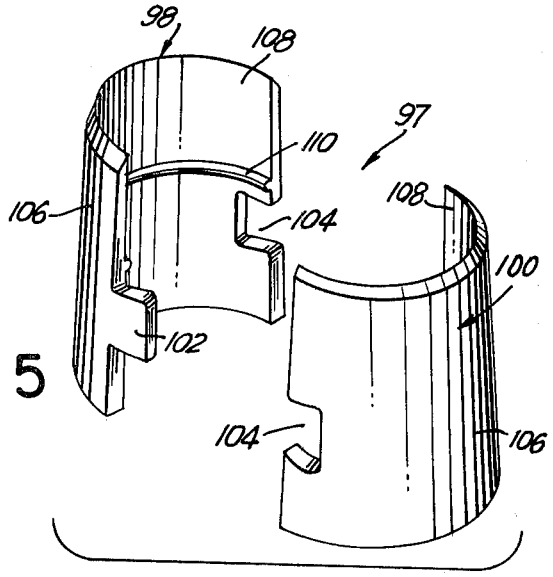
FIG. 5 is a perspective view showing the matingly engaging frustroconical sleeve sections utilized for clamping onto a support post.
Figure 6:
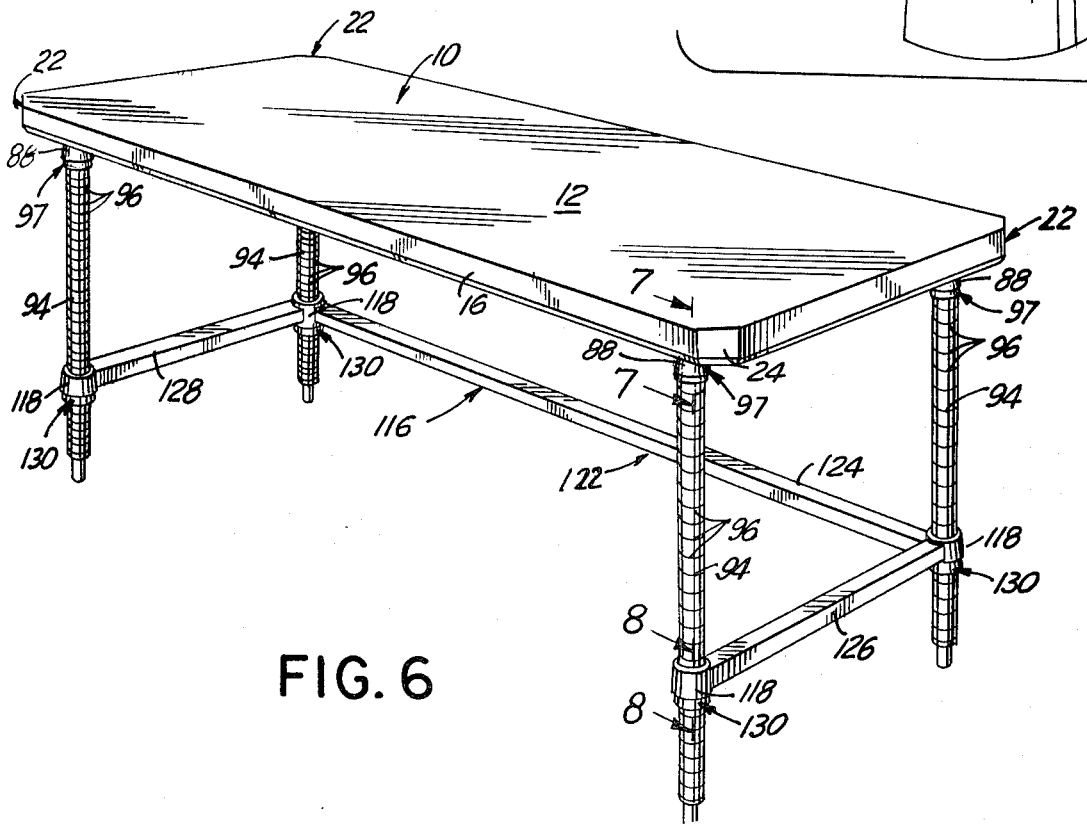
FIG. 6 is a perspective view of one embodiment of the assembled work table, including a three sided stabilizing frame on the lower portion thereof.

As shown in FIG. 6, the table top 10 is positioned on top of four support posts 94. The support posts 94 are tubular members which have a plurality of spaced apart recesses 96. These recesses 96 are typically annular grooves formed about the periphery of the support posts. In order to secure the table top 10 onto the support posts 94, support sleeves 97 are utilized, as is best shown in FIGS. 5 and 7. The sleeves 97 are formed of two mating half sections 98, 100 which are similar and engagable with each other when mounted onto the support posts 94. When mated, the two half sections 98, 100 tend to hold one another in fixed position. For this purpose, there is provided a tongue and groove construction 102, 104 which is suitable for connecting the half sections together. In this regard, reference may be had to U.S. Pat. Nos. 3,424,111; 3,523,508; 3,604,369; and 3,757,705, as well as co-pending application Ser. No. 252,812, all of which are herein incorporated by reference to supplement the description of the support posts, the securing means for the shelves and the sleeves, as well as further material contained therein.

Generally, the external surfaces 106 of the half sections 98, 100 when joined, define a frustroconical shape which corresponds to the internal taper of the bore 92 in the collar 88 projecting from the frame 42. The internal surfaces 108 of the sleeve sections 98, 100, when joined, form a cylindrical surface which corresponds to the external surface of the cylindrical support posts 94.

An internal rib or protrusion 110 is provided in each sleeve section 98, 100 to engage the annular slot or recess 96 formed peripherally about the support posts 94.

The sleeve sections 98, 100 are placed about the support posts adjacent to their upper surface, as shown in FIG. 7. Typically, they can be placed about the uppermost annular recess provided on the support post. The protusion 110 of each sleeve section is positioned at the recess 96. The two half sections 98, 100 are then snapped into place so that they are joined in proper engagement with their protrusions 110 locked in the recess 96. The table top 10 is then placed over these annular joined sleeves 97 so that the respective collars 88 are mounted on top of the joined sleeves 97.

A tight and secure fit is obtained between the matingly engaged sleeve sections 98, 100 as the weight of the table top presses down onto the sleeve sections. By adding a load of weight onto the table top, the corner collars 88 are further urged downwardly, which causes a wedging action so as to provide a gripping force against the external surface of the sleeve sections 98, 100. This increases as the table top is loaded.

In this connection, when the sleeve 97 is formed as two halves, the confronting edges of each half advantageously do not make actual contact, to thereby permit full pressure to be exerted against the surface of each post. A more specific description of the above described action is more fully described in the U.S. Pat. No. 3,424,111.

As can be seen in FIG. 7, because the upper end of the collar 88 is connected to the U-shaped channel, the annular tapered bore 92 in the collar 88 communicates with the space 112 provided in the U-shaped channel. In this manner, the upper end 114 of the support posts 94 can extend upwardly past the collar 88 and into the space 112. As a result, there is provided a space between the upper ends 114 of the support posts 94 and the table top 10 to permit the urging downward of the table top so as to permit the additional wedging action heretofore described. Additionally this space permits some flexibility in the positioning of the uppermost annular recess 96 provided on the support posts 94.

Preferably, a plastic cap or cover member 115 having an enlarged head portion, is force-fit into the open upper end 114 of the support post 94, as shown in FIG. 7, to close the upper end 114 to avoid the possible collection of food particles and dirt therein.

Figure 4:
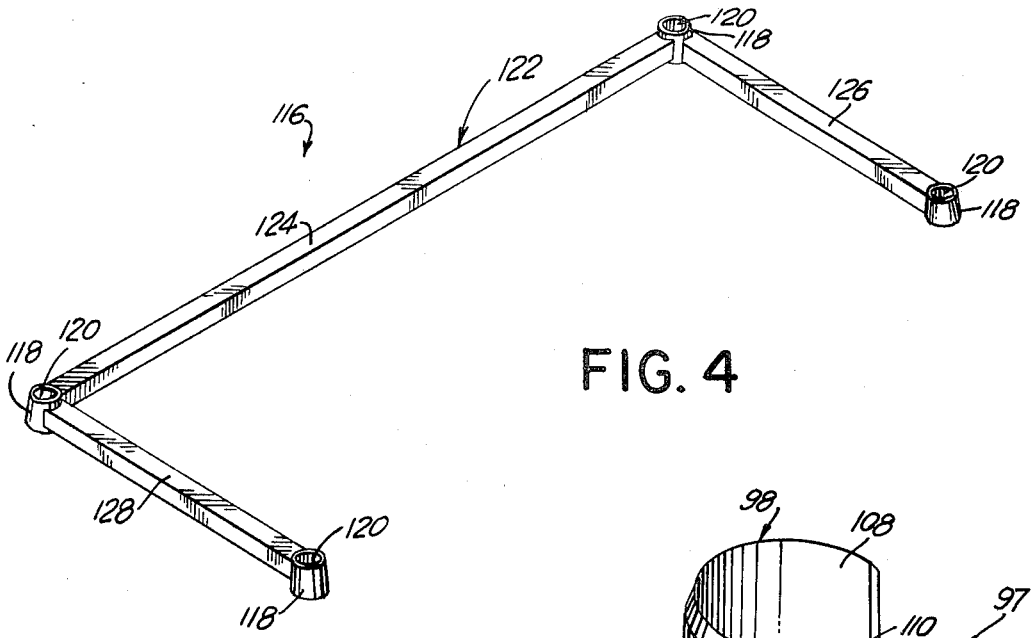
FIG. 4 is a perspective view of the three sided frame for additional support of the work table.

Referring now to FIG. 6, it will be noted that in addition to the table top 10, the support posts 94 also support a three sided frame member 116 which serves to stabilize the support posts 94 while allowing the placement of carts under the table top 10. As can best be seen in FIGS. 4 and 6, the frame 116 includes four corner frustroconical collars 118 each having an internal tapered bore 120. The four collars 118 are interconnected by means of the rod sections 122, including the side rod 124, and the two end rods 126, 128. The rod sections 122 can typically be of rectangular, tubular, trapezoidal or other cross sectional configuration, as is well known in the art. Preferably, the rod sections 122 are tubular members which are welded to the collars 118.

Figure 8:
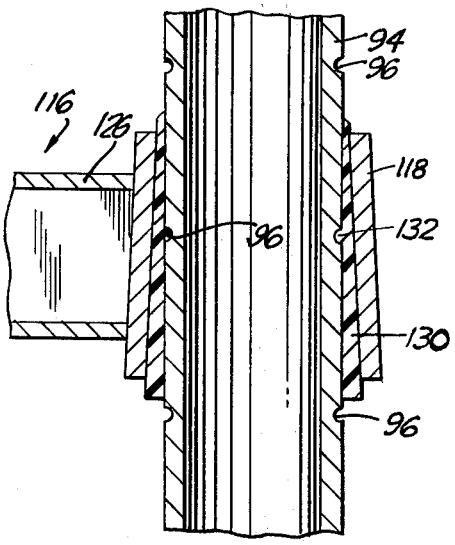
FIG. 8 is a sectional view taken along line 8—8 of FIG. 6, showing the interconnection of the three sided frame onto the support post.

As is best seen in FIGS. 6 and 8, the position of the three sided frame 116 can be suitably adjusted by utilizing the sleeves 130, of a type substantially identical to the sleeve 97 shown in FIG. 5. The projection 132 internal of each sleeve 130, similar to the above mentioned projection 110, fits within one of the recesses 96 provided on each support post 94. Each collar 118 sits over the frustroconical exterior surface of an associated sleeve 130 and urges together the sleeve sections so as to provide a suitable gripping force against each support post 94 for firmly securing the frame 116 in place, in a manner set forth above. The exact positioning of the three sided frame 116 can be suitably adjusted so as to place it at any desired height along the support posts by selecting the desired annular recesses 96 in which to snap the sleeve sections.

Figure 9:
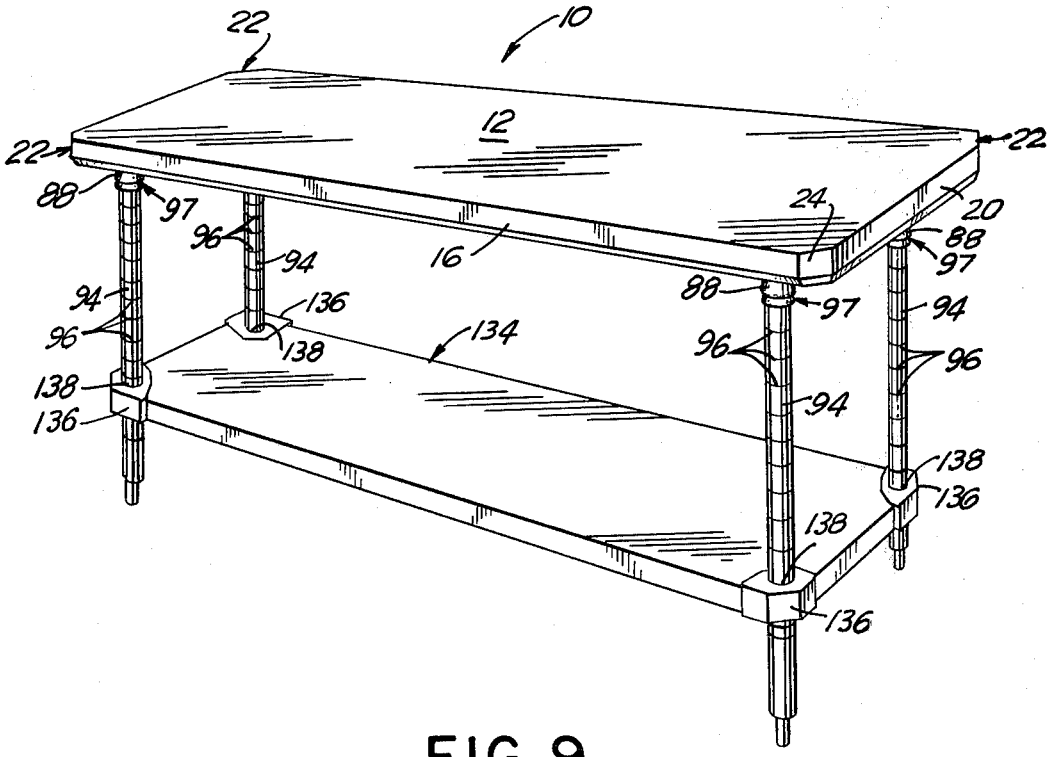
FIG. 9 is a perspective view of another embodiment of the present invention, showing a lower adjustable shelf arrangement.

Referring now to FIG. 9, instead of utilizing the three sided frame 116, it is also possible to provide one or more undershelves beneath the table top 10. The particular undershelf 134 which is shown is of a type described and claimed in the aforementioned copending U.S. patent application Ser. No. 252,812. In such copending application, there is described the use of the removable corner sections 136 which are secured in place on the truncated corners of the shelf 134. The annular tapered bores 138, formed in the corners 136, are such as to receive the sleeve sections of a sleeve member as shown in FIG. 5. Such heavy duty shelving 134, with the removable corner sections 135 attached, sits onto the snapped together sleeve sections and provides the additional wedging action so as to provide additional gripping force of the sleeve members onto the support posts 94. Although only one shelf 134 has been shown, it should be understood that additional undershelves can be placed on the support posts, as is needed.

It should be appreciated that the present work table is essentially of the knock down type. More particularly, the table top can be assembled by first placing any undershelf or any desired three sided frame in place on the support shelves by utilizing the snap together sleeve sections, and then placing the shelf or frame in position on such sleeves. Sleeves are then positioned adjacent the upper ends of the support posts, and the table top is then placed with its depending collars on top of the snapped together sleeve sections. It should be appreciated, that although a knock down table is described, it does not require the use of any tools for assembly thereof and, nevertheless, is substantially easy to assemble. Furthermore, the assembly is achieved without the use of any nuts or bolts passing through the legs. Although such work table is rigid, and can be easily assembled, there is provided a ready adjustment of the undershelf height, and/or the installation of additional shelves as desired. Such adjustment or further installation can also be achieved without the necessity of placing bolts through the legs. In the prior art, adjustments or addition of shelves requiring the drilling of new holes and as a result, required sealing of the unused holes so as to prevent the chance of contamination. Such is avoided in the present invention.

A further improvement is the fact that the entire upper surface is smooth, planar, and without any seams or cracks. As a result, complete cleanliness and usability is provided for many fields, especially in the food service industry.

Additionally, because of the complete continuous peripheral skirt and lip, an improved and unique appearance is provided to the work table. Also, a "softer" corner is provided which is less objectionable when leaned against. This particular "softer" corner avoids the prior art spherical corners or vertical seams which had previously been utilized and were objectionable.

Although the lower undershelf of the present invention was shown as a sheet metal shelf, the present invention could also be utilized with wire shelving, such as the type of wire shelving described in the above-mentioned U.S. Pat. No. 3,874,511.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. A work table comprising:

a table top;

corner support posts for supporting said table top, recesses being provided on each post adjacent respective upper ends thereof;

a pair of matingly engaging sleeve sections for clamping about each support post, said sleeve sections being joined to provide a tapered exterior surface, protruding means being provided internally in each of said sleeve sections for locking into an associated one of said recesses on said support posts;

corner collar members having a respective tapered bore therein, said corner collar members being secured to an underside of said table top for receiving respective pairs of said sleeve sections and urging them into a secure clamping engagement on said support posts;

a support frame secured onto said underside of said table top, said collar members depending from said support frame; and said support frame including a pair of elongated, side channel members, and a pair of elongated end angle members interconnecting said side channel members and closing off their respective open ends so as to provide a closed support frame.

2. A work table as in claim 1, wherein said collar members extend from said side channel members with said tapered bores in said collar members extending entirely therethrough to communicate with a space provided within each of said channel members, said upper ends of the support posts projecting into the spaces within said channel members.

3. A work table as in claim 1, wherein said support frame is inwardly spaced from a peripheral edge of said table top.

4. A work table as in claim 1, and further comprising a downwardly depending skirt peripherally provided about said table top, and a peripheral lip inwardly extending from a distal end of said skirt.

5. A work table as in claim 4, wherein said said table top includes truncated corners, and wherein said skirt is continuous around said truncated corners.

6. A work table as in claim 1, wherein said table top has a planar upper surface, said upper surface being a unitary sheet throughout so as to avoid any cracks or crevices therein.

7. A work table as in claim 1, wherein said collar members are tapered sleeves.

8. A work table as in claim 1, wherein said corner posts are provided with spaced apart recesses along substantially their entire length, and further comprising a lower shelf having truncated corners, corner connectors coupled to each truncated corner, each corner connector having a tapered bore therethrough, and a pair of said matingly engaging sleeve sections associated with each of said corner connectors to securely retain said lower shelf in a supported position at a desired location on said support posts.

9. A work table as in claim 1, wherein each of said channel members includes a pair of legs connected by a bight portion to be U-shaped in cross section, said channel members having connecting arms laterally extending from distal ends of said legs, and said angle members are L-shaped in cross section having a width of one leg thereof at least equal to a height of said channel member to thereby completely seal the open ends of said channel members, the other leg of said L-shaped angle members serving as a connecting leg.

10. A work table as in claim 9, and further comprising sealing tape interposed between said underside of said table top and said connecting arms and connecting legs to avoid direct contact therebetween.

11. A work table as in claim 9, and further comprising elongated fastening members projecting from said underside of said table top, receiving apertures provided in said connecting arms and connecting legs for receiving said fastening members extending therethrough, and clamping means for locking onto extended ends of said fastening members to secure said support frame onto said underside of said table top.

12. A work table comprising:

a table top;

corner support posts for supporting said table top, recesses being provided on each post adjacent respective upper ends thereof;

a pair of matingly engaging sleeve sections for clamping about each support post, said sleeve sections being joined to provide a tapered exterior surface, protruding means being provided internally in each of said sleeve sections for locking into an associated one of said recesses on said support posts;

corner collar members having a respective tapered bore therein, said corner collar members being secured to an underside of said table top for receiving respective pairs of said sleeve sections and urging them into a secure clamping engagement on said support posts;

said corner posts being provided with spaced apart recesses along substantially their entire length;

a lower three sided frame member having four corner collar elements with a respective tapered bore in each collar element;

three bar members interconnecting said corner collar elements; and a pair of said matingly engaging sleeve sections associated with each of said four corner collar elements to securely retain said lower frame member in a supported position at a desired location on said support posts.

13. A work table as in claim 12, and further comprising a support frame secured onto said underside of said table top, said collar members depending from said support frame.

14. A work table as in claim 13, wherein said support frame is inwardly spaced from a peripheral edge of said table top.

15. A work table as in claim 12, and further comprising a downwardly depending skirt peripherally provided about said table top, and a peripheral lip inwardly extending from a distal end of said skirt.

16. A work table as in claim 15, wherein said table top includes truncated corners, and wherein said skirt is continuous around said truncated corners.

17. A work table as in claim 12, wherein said table top has a planar upper surface, said upper surface being a unitary sheet throughout so as to avoid any cracks or crevices therein.

18. A work table as in claim 12, wherein said collar members are tapered sleeves.

* * * * *